US008534769B2

(12) United States Patent
Loetscher et al.

(10) Patent No.: US 8,534,769 B2
(45) Date of Patent: Sep. 17, 2013

(54) METHOD FOR PRODUCING TOOTHBRUSHES BRISTLED IN AN ANCHORLESS MANNER

(75) Inventors: Jost Loetscher, Bueron (CH); Oskar Trevisan, Reussbuhl (CH)

(73) Assignee: Trisa Holding AG, Triengen (CH)

( * ) Notice: Subject to any disclaimer, the term of this patent is extended or adjusted under 35 U.S.C. 154(b) by 121 days.

(21) Appl. No.: 12/991,528

(22) PCT Filed: Jun. 4, 2009

(86) PCT No.: PCT/EP2009/003999

§ 371 (c)(1),
(2), (4) Date: Dec. 6, 2010

(87) PCT Pub. No.: WO2009/146909

PCT Pub. Date: Dec. 10, 2009

(65) Prior Publication Data

US 2011/0109149 A1 May 12, 2011

(30) Foreign Application Priority Data

Jun. 7, 2008 (EP) ..... 08010409

(51) Int. Cl.
*A46D 3/04* (2006.01)

(52) U.S. Cl.
USPC ..... 300/21; 300/2

(58) Field of Classification Search
USPC ..... 300/2, 4, 5, 8, 17, 21
See application file for complete search history.

(56) References Cited

U.S. PATENT DOCUMENTS

| | | | | |
|---|---|---|---|---|
| 4,979,782 | A | 12/1990 | Weihrauch | |
| 5,728,408 | A * | 3/1998 | Boucherie | 425/116 |
| 6,290,302 | B1 * | 9/2001 | Boucherie | 300/3 |
| 6,764,142 | B2 | 7/2004 | Kwon | |
| 6,779,851 | B2 | 8/2004 | Boucherie | |
| 7,419,225 | B2 | 9/2008 | Fischer et al. | |
| 2001/0050507 | A1 | 12/2001 | Boucherie | |
| 2002/0116778 | A1 | 8/2002 | Kwon | |
| 2004/0070258 | A1 | 4/2004 | Kwon | |

(Continued)

FOREIGN PATENT DOCUMENTS

| | | | |
|---|---|---|---|
| DE | 200 06 311 | U1 | 9/2001 |
| DE | 20 2004 018 612 | U1 | 5/2005 |

(Continued)

OTHER PUBLICATIONS

JP2006167027 (machine translation).*

(Continued)

*Primary Examiner* — Mark Spisich
*Assistant Examiner* — Andrew A Horton
(74) *Attorney, Agent, or Firm* — Oliff & Berridge, PLC

(57) ABSTRACT

The tips of pointed bristles are mechanically processed in order to remove any corroded threads or residual threads from the tip. Mechanically processed pointed bristles are fed to a receptacle recess of a tool in bundles, and aligned by means of a pin guided in the receptacle recess. The pointed bristles are pushed through the passage of the bristle carrier plate, and the end section are subsequently melted by means of a heating die in order to attach the pointed bristles to the bristle carrier plate. The mechanical processing of the tips of the bristles enables an error-free further processing of the pointed bristles utilizing the bristling method, particularly the AFT method.

19 Claims, 5 Drawing Sheets

(56) References Cited

U.S. PATENT DOCUMENTS

| | | | | |
|---|---|---|---|---|
| 2004/0083569 | A1* | 5/2004 | Kweon et al. | 15/167.1 |
| 2004/0164604 | A1* | 8/2004 | Boucherie | 300/5 |
| 2005/0116528 | A1* | 6/2005 | Boucherie | 300/5 |
| 2006/0096053 | A1 | 5/2006 | Fischer et al. | |
| 2006/0107478 | A1 | 5/2006 | Boucherie | |
| 2007/0170772 | A1* | 7/2007 | Kwon et al. | 300/21 |
| 2008/0148502 | A1 | 6/2008 | Fischer et al. | |
| 2008/0238182 | A1 | 10/2008 | Fischer et al. | |

FOREIGN PATENT DOCUMENTS

| | | | |
|---|---|---|---|
| DE | 10 2006 026 712 | A1 | 12/2007 |
| EP | 0 346 646 | A2 | 12/1989 |
| EP | 1 234 525 | A2 | 8/2002 |
| EP | 1 864 588 | A2 | 12/2007 |
| JP | 2006167027 | A * | 6/2006 |
| WO | WO 2004/093718 | A1 | 11/2004 |
| WO | WO 2007043848 | A1 * | 4/2007 |

OTHER PUBLICATIONS

International Search Report issued in Application No. PCT/EP2009/003999; Dated Mar. 17, 2010 (With Translation).

International Preliminary Report on Patentability issued in Application No. PCT/EP2009/003999; Dated Jan. 11, 2011.

* cited by examiner

METHOD FOR PRODUCING TOOTHBRUSHES BRISTLED IN AN ANCHORLESS MANNER

The present invention relates to a method for producing toothbrushes covered with bristles in an anchor-free manner, in which a cluster of bristles is introduced into an accommodating aperture of a tool of a bristle-covering machine and a pin, which is guided in the accommodating aperture, acts for the purpose of aligning the bristles of the cluster of bristles, on that end of the bristles which is directed toward the pin.

Bristle-covering machines which operate by this method are known in general and are produced and sold, for example, by G.B. Boucherie N.V., Izegem, Belgium, in the form of so-called AFT machines (Anchor Free Tufting machines). An apparatus by means of which bristle-carrying plates provided with clusters of bristles are fastened on brush bodies is disclosed, for example, in DE 200 06 311 U1.

A further type of bristle-covering machine for producing anchor-free bristled goods is known from EP 0 346 646. In contrast to the aforementioned AFT technology, in which the bristles are fastened by melting, in this case the bristles are encapsulated by means of plastics material, for anchoring purposes, in an injection-molding machine (In Mold Tufting IMT).

A further type of bristle-covering machine for producing anchor-free toothbrushes is known from DE 10 2006 026 712. This machine combines the aforementioned methods. A bristle-carrying plate provided with clusters of bristles (in a manner analogous to a bristle-covered bristle-carrying plate from the AFT process) is positioned in a cavity of an injection mold, into which plastics material is then injected (IMT) for anchoring purposes and for forming the rest of the brush head.

Although the bristle-anchoring operation is realized in different ways in the methods described, it is nevertheless possible to proceed in the same, or similar, way for the purposes of preparing, processing and feeding bristles.

The known methods and the aforementioned known bristle-covering machines on which these methods are executed are designed for the processing of conventional cylindrical bristles, i.e. of bristles which have a constant circular-cylindrical cross section over their length. The edges which are produced as a result of the conventional bristles being cut off from filament-like starting material are rounded on the later user's end of the bristles by mechanical processing in the bristle-covering machine in order to prevent injury, in particular to the gums, when the toothbrush is being used. The mechanical processing gives the corresponding end of the conventional bristles a more or less hemispherical shape. These conventional bristles, once processed, are fed in clusters to a tool, a movable pallet, which, for each cluster of conventional bristles, has a cylindrical accommodating aperture in which a pin is guided with a sliding fit. The clusters of conventional bristles are introduced into the accommodating aperture with the mechanically processed end in front, and therefore the processed ends butt against the pin. By virtue of the pin being raised, the conventional bristles are pushed first of all through a hopper plate and then directly through a through-passage of a bristle-carrying plate, until an end region of the conventional bristles which is directed away from the rounded end of the conventional bristles projects beyond the underside of the bristle-carrying plate, the underside in this arrangement being located at the top. This end region of the conventional bristles is then melted in order to fasten the cluster of bristles on the bristle-carrying plate. This plate is then fastened on the head of a toothbrush body, for example as disclosed in DE 200 06 311 U1.

The IMT method according to EP 0 346 646 can proceed in the same way. However, rather than being pushed through a bristle-carrying plate, the bristles project freely into a cavity of an injection mold, into which plastics material is then injected for the purposes of anchoring the bristles and of forming the brush head.

The known methods and the known bristle-covering machines are intended, and designed, for processing conventional cylindrical bristles. In recent times, the need for toothbrushes with tapered bristles has increased because such bristles, while providing for good cleaning of the teeth, are also suitable in particular for cleaning the region between the teeth and are gentle on the gums.

Specialists, however, are of the opinion that it is technically very difficult to use the known methods for covering brushes with bristles in an anchor-free manner and to use the associated known bristle-covering machines for processing such tapered bristles. The applicant has described initial tests with tapered bristles in anchor-free bristle-covering methods for manual and electric toothbrushes in WO 2004/093718.

In particular it appears to make no sense to subject the points of the already tapered bristles to mechanical processing since it is precisely these points which are desired. EP 1 234 525 should be mentioned here by way of example for producing such chemically tapered bristles.

It is therefore an object of the present invention to provide a method which makes it possible to cover toothbrushes with tapered bristles in an anchor-free manner.

A further object of this invention is to provide a toothbrush with chemically tapered bristles of which the ends are specially tapered.

Furthermore, it is also an object of the present invention to provide a bristle-covering machine for implementing the method according to the invention.

To overcome the prejudice of it not being possible to process tapered bristles on AFT machines, according to the invention bristles which are tapered chemically at one end, and have a portion which tapers to a point and a cylindrical portion, which adjoins the tapered portion and has a blunt end, are introduced in clusters into the accommodating aperture of a tool or of a pallet such that the tapered bristles are located in the accommodating aperture over their entire length. A pin acts on the points; the tapered bristles are preferably thus pushed through a hopper plate; this means that a desired height profile can be achieved for the bristle arrangement. In order to make this possible, the points of the tapered bristles are processed mechanically, in addition, prior to introduction into the accommodating aperture.

It should be expressly pointed out that, without departing from the framework of the invention, as an alternative to "chemically" tapered bristles, it is also possible for bristles which have been tapered using other methods to be fed according to the invention to the bristle-covering machine. Examples of possible alternative methods for tapering the bristles are special extrusion of the bristles, this allowing tapered segments, various mechanical processing methods, thermal methods or combinations thereof.

Tests using the previously known AFT methods with chemically tapered bristles have shown that the prejudice was justified. Chemically tapered bristles, in particular in the peripheral region of the respective cluster of bristles, were caught between the tool, that is to say the pallet, and the pin, which, on the one hand, gave rise to disruption and, on the other hand, resulted in an unusable bristle covering since the tapered bristles were damaged on the surface as a result of being caught. During the laborious search for the cause, it was determined that bristles tapered chemically using generally known methods can have, at the point, an extremely thin etching-process filament or residual filament. Tests on tapered bristles have then shown that these etching-process filaments or residual filaments can be eliminated by means of the known mechanical processing of the bristle ends. Surprisingly, tests with such mechanically processed tapered bristles have then shown that eliminating the etching-process filaments or residual filaments also makes it possible to prevent the bristles from getting caught between the tool and the pin. The mechanical processing thus results in a defined termination at the point of the chemically tapered bristles, and this termination allows problem-free further processing.

The points of the tapered bristles are preferably processed mechanically directly in the bristle-covering machine in order for the etching-process filaments or residual filaments to be removed. This makes it possible to use chemically tapered bristles as are commercially available. It would likewise be possible for the mechanical processing of chemically tapered bristles to be carried out outside the bristle-covering machine in order then for these prepared tapered bristles to be fed subsequently to the bristle-covering process without any further processing being required.

According to a preferred embodiment of the method according to the invention, during the mechanical processing, the points of the bristles are ground, in particular by means of a grinding disk. Of course, it is also possible to use other methods, preferably processing units, which are known to a person skilled in the art. Possible examples here are lasers, chemical methods, other mechanical methods or thermal methods or combinations thereof.

Use is preferably made of bristles of which the tapered portion has at least a length of 5 mm. Preferably, however, the tapered portion is longer and measures between 7 and 12 mm, in particular between 8 and 11 mm. Such tapered bristles, while providing a good cleaning effect, ensure particularly gentle treatment of the gums and good cleaning of the spaces between the teeth.

In a particularly preferred manner, the tapered bristles, in contrast to the conventional bristles which are cylindrical throughout, during the mechanical processing of the points, are retained or clamped at least more or less in the transition region between the cylindrical portion and the tapered portion. On the one hand, this reduces the risk of tapered bristles being displaced on account of a force acting on the bristles in the direction of the blunt end and, on the other hand, the tapered bristles are stabilized during the mechanical processing. If an improved bristle-covering machine is used in order to implement this preferred embodiment of the method according to the invention, this operation of retaining the tapered bristles is executed preferably by means of a rounding disk, or by means of elements of the bristle-covering machine which are associated with the rounding disk, and of a pressure-exerting element which interacts therewith.

On a bristle-covering machine according to the invention, it is possible simultaneously to process tapered bristles by the method according to the invention and conventional bristles, which are cylindrical throughout, and for these to be anchored in the same brush head. The bristles here, however, are introduced into the machine in separate feed channels for the tapered bristles and separate feed channels for the conventional bristles.

Further preferably, the tapered bristles, during the mechanical processing of the points, are retained in an aligned state by means of a stop plate which interacts with the blunt end of the tapered bristles. This ensures that the points of all the tapered bristles are processed mechanically and cannot yield out of the way.

The sliding fit between the tool and pin is preferably configured such that the points of the mechanically processed tapered bristles have a diameter which is larger than the tolerance range of the sliding fit.

Further preferably, the pin has a concave region on its upper end side, which is located in the tool. This gives the cluster of bristles a convex topography, in which the points of the mechanically processed tapered bristles are located.

A topography is created on the cluster of bristles preferably only following the mechanical processing of the bristles.

In the case of a further particularly preferred embodiment of the method according to the invention, the tapered bristles, prior to the mechanical processing of the points, are positioned with the point directed downward in a feed channel of the bristle-covering machine and in the feed channel are pushed, by means of a pusher, in the direction of an outlet of the feed channel, wherein the pusher acts on the cylindrical portion of the tapered bristles.

This gives rise to particularly straightforward handling of the tapered bristles, wherein the situation where a force is generated as a result of the pusher acting in the direction of the blunt end of the tapered bristles is avoided. The tapered bristles here remain with their point butting, or at least more or less butting, against the base of the feed channel and movement of bristles away from the base of the feed channel is avoided.

When the method according to the invention is executed on an adapted bristle-covering machine, the adapted material channel serves as the feed channel. The bristle-covering machine can have both material channels for conventional bristles, which are cylindrical throughout, and adapted feed channels for tapered bristles.

In a further-preferred embodiment of the method according to the invention, the tapered bristles are retained in the feed channel by means of a boundary plate which interacts with the blunt end of the bristles. Together with the adapted arrangement of the pusher, which acts on the cylindrical part of the tapered bristles, this prevents the situation where the tapered bristles rise up away from the base of the feed channel. When use is made of a known bristle-covering machine, the striking plate is preferably used as a boundary plate, this striking plate nevertheless being at a standstill. This means that the striking movement which is common during the processing of conventional cylindrical bristles is absent.

A bristle-carrying plate having at least one through-passage is preferably arranged on the tool, and the tapered bristles of the cluster of bristles are pushed through the through-passage by means of the pin such that the tapered bristles project beyond the underside of the top of the bristle-carrying plate by way of an end portion of the cylindrical portion which has the blunt end. These end portions of the bristles are then melted in order to fasten the tapered bristles on the bristle-carrying plate. If appropriate, a hopper plate, on which the bristle-carrying plate is arranged, may be arranged directly on the tool. The hopper plate has at least one guiding through-passage for the tapered bristles, wherein this through-passage may be tapered in a funnel-like manner, as seen from the tool. As an alternative, although less preferred, this step is dispensed with if there is no bristle-carrying plate integrated in the method (for example IMT).

Further preferably, previously mechanically processed conventional bristles, which are otherwise cylindrical over their length, are introduced into a further accommodating aperture of the tool. A further pin, which is guided in this accommodating aperture, acts, for the purpose of aligning the conventional bristles, on the processed ends of these bristles.

In the case of a correspondingly shaped end side, the cluster of conventional bristles can be given a topography.

Topography, in conjunction with the present invention, is intended to mean a surface area which is defined by the points of the tapered bristles and/or the relevant ends of the conventional bristles and is shaped three-dimensionally or may be planar, although in this case it does not run at right angles to the longitudinal direction of the relevant cluster of bristles.

It is preferable—using identical tools—for the points of the tapered bristles to be processed mechanically for a shorter period of time than the ends of the conventional bristles.

If (only) tapered bristles are introduced into closely adjacent accommodating apertures and (only) conventional bristles are introduced into closely adjacent further accommodating apertures, the bristles can be retained particularly securely on a bristle-carrying plate by virtue of the end portions of the bristles being melted even when the conventional and the tapered bristles are produced from non-affinitive plastics materials.

The method according to the invention can also be used to produce toothbrushes which are covered with bristles in an anchor-free manner and in which a cluster of bristles has both tapered bristles and conventional bristles. For this purpose, the tapered bristles can be introduced into one accommodating aperture, and the conventional bristles can be introduced into a further accommodating aperture, of the tool. These accommodating apertures are preferably located directly one beside the other. When these clusters of bristles are subjected to a pushing action by means of the pins, the bristles can be directed, preferably by means of a hopper plate, to a common through-passage of the bristle-carrying plate.

The bristle-carrying plate is then, as is known, fastened on the head of a toothbrush body.

The method according to the invention can also be used for fastening clusters of tapered bristles directly on the head of the toothbrush body by virtue of appropriate through-passages being formed in the latter.

For the purpose of implementing the method according to the invention, use is preferably made of a known bristle-covering machine, wherein the latter, as indicated in the relevant claims, is designed and/or operated differently for the processing of tapered bristles.

The method according to the invention is used, in particular, for producing electric and manual toothbrushes. Of course, the method can be used in general for bristled goods with tapered filaments, in particular also for bristled goods in the industries covering cosmetics, body-care products and medical goods.

In addition to the tapered bristles processed according to the invention, the toothbrush may also have conventional bristles, which are cylindrical throughout, and/or elastomeric cleaning elements made of soft material.

The invention will be described in more detail with reference to an exemplary embodiment illustrated in the drawing, in which, pure schematically:

FIG. 1 shows a perspective view of a bristle-carrying plate;

FIG. 2 likewise shows a perspective view of the bristle-carrying plate, this time provided with a bristle arrangement made of at least partially tapered bristles;

Figure 8:
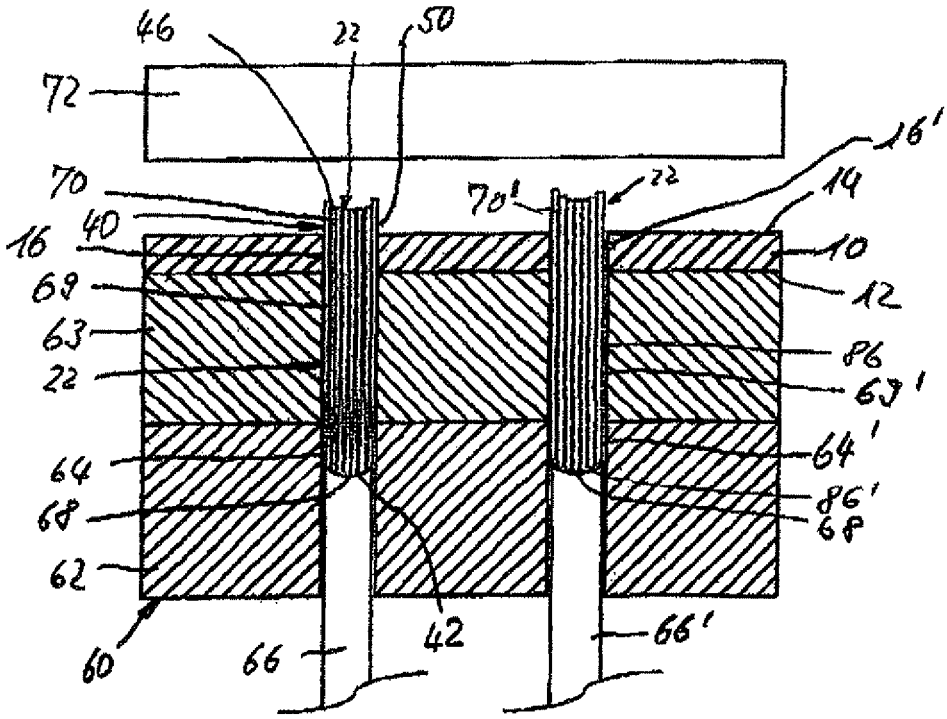
Figure 9:
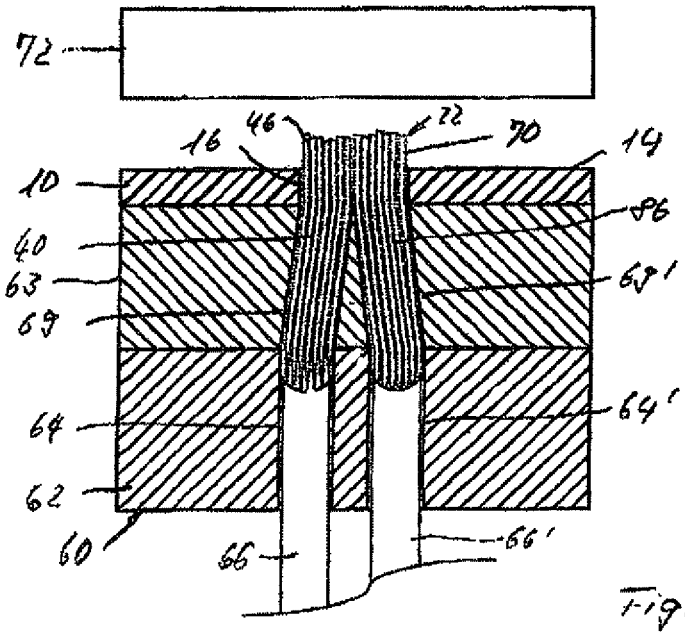
Figure 10:
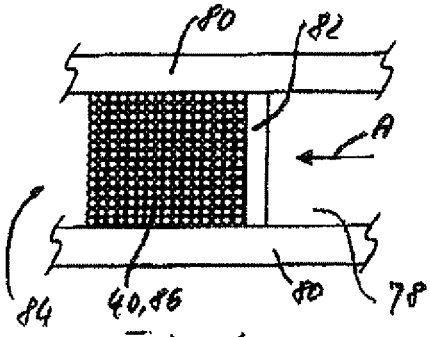
Figure 11:
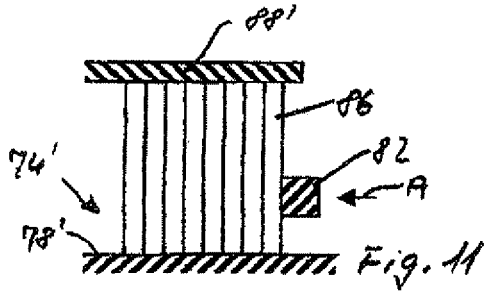
Figure 12:
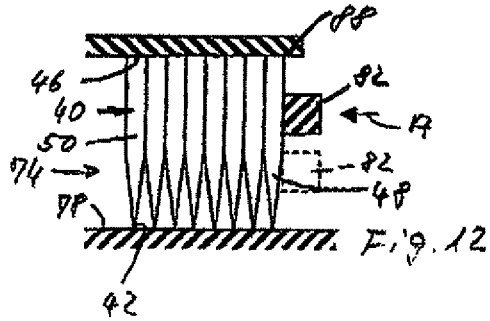
Figure 13:
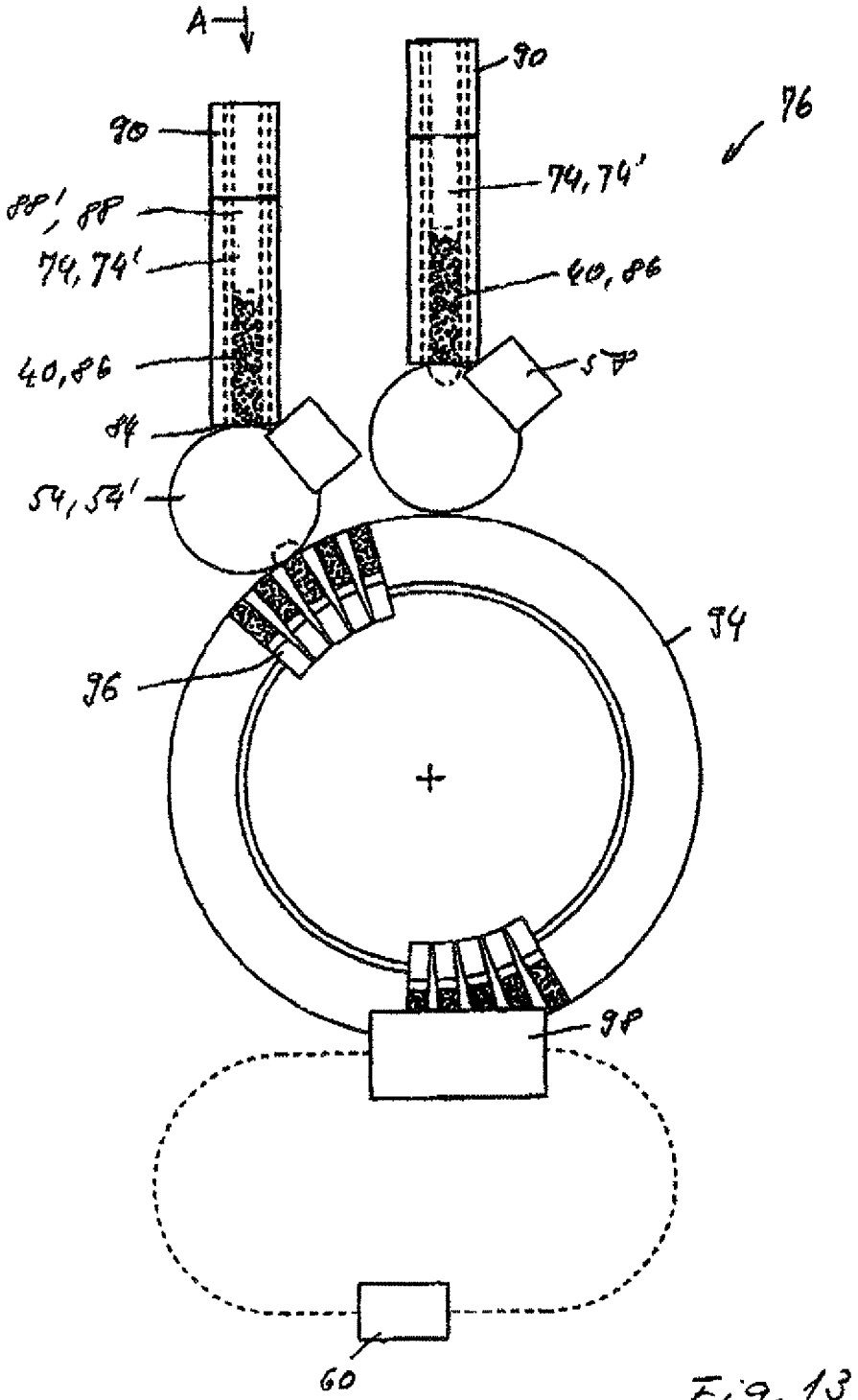
Figure 14:
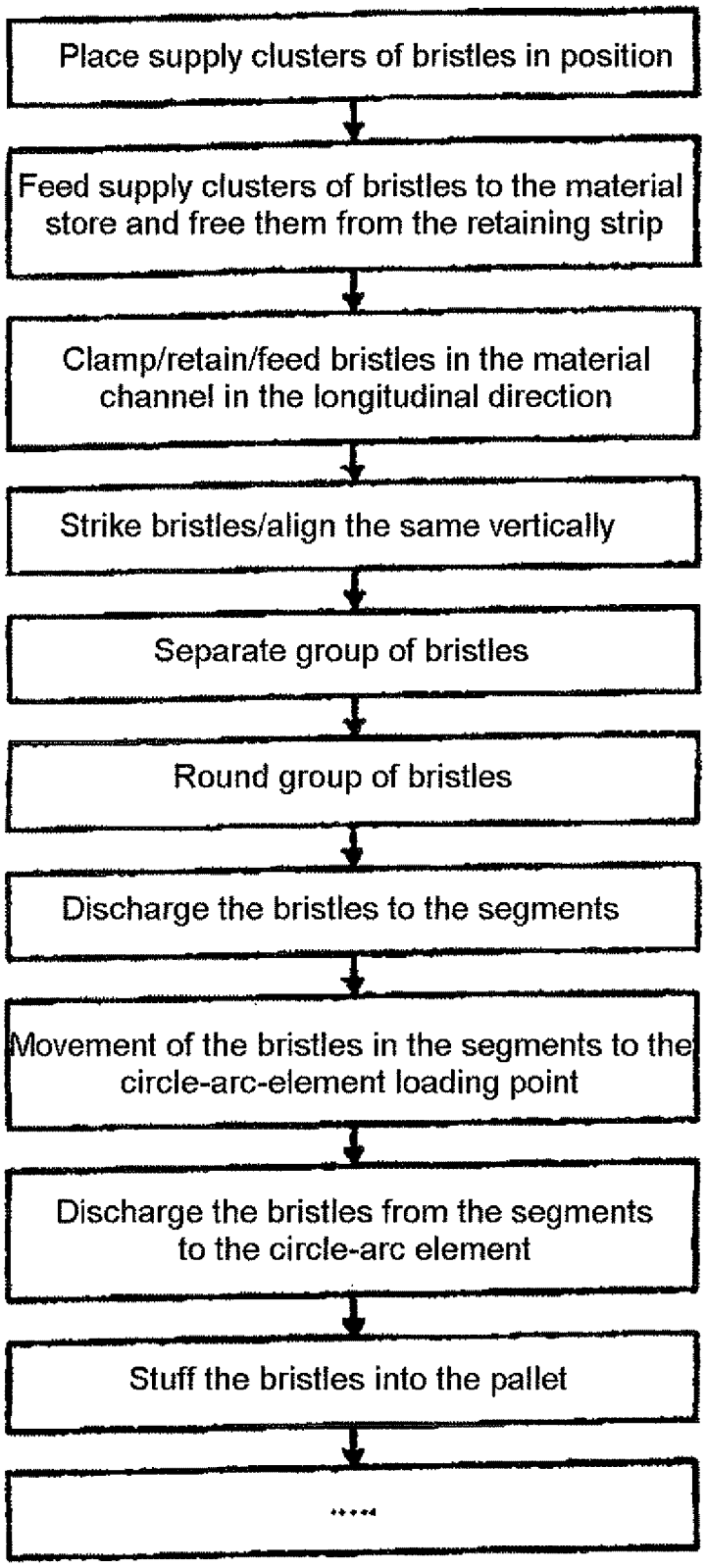

FIG. 8 shows a section through a tool having an accommodating aperture for the tapered bristles and having a further accommodating aperture for conventional bristles, having a pin guided in the accommodating aperture, and having a further pin guided in the further accommodating aperture, for moving and aligning the bristles, having a bristle-carrying plate arranged on a hopper plate, and having a heating die;

FIG. 9 shows the tool having the accommodating apertures and the pins, having the bristle-carrying plate arranged on the hopper plate, and having the heating die, illustrated in the same way as in FIG. 8, wherein the hopper plate directs the tapered bristles and the conventional bristles to a common through-passage of the bristle-carrying plate;

FIG. 10 shows a plan view of a feed channel of a bristle-covering machine with tapered or conventional bristles arranged therein and with a pusher acting on the bristles;

FIG. 11 shows a longitudinal section through a portion of a material channel of a bristle-covering machine with conventional cylindrical bristles arranged in the material channel and the pusher;

FIG. 12 shows, in the same way as FIG. 11, the portion of the feed channel with tapered bristles arranged therein and with the pusher further away from the base;

FIG. 13 shows a plan view of an AFT machine adapted for implementing the method according to the invention; and FIG. 14 shows a flow diagram with steps of the method according to the invention.

Figure 1:
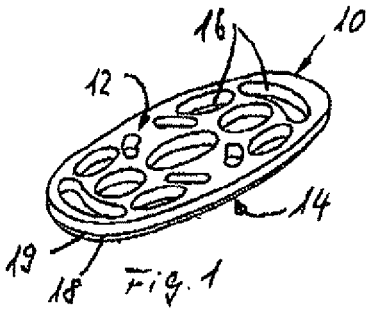

FIG. 1 shows a possible bristle-carrying plate 10 in a perspective view as seen obliquely from above. A number of through-passages 16 extend from the upper side 12 to the underside 14 of this bristle-carrying plate. These through-passages, in the example shown, have a kidney-shaped or oval cross section. The through-passages may also have a round, or any other desired, cross section. An annular centering bead 18 projects downward from the underside 14, and this centering bead extends along the side edge of the bristle-carrying plate 10, at a small distance from this side edge, and is tapered in a wedge-shaped manner preferably in the direction of the free end. An encircling welding edge 19 runs along the side edge of the bristle-carrying plate 10 on the underside 14 thereof, directly alongside the centering bead 18. This welding edge is used for connecting the bristle-carrying plate 10 and toothbrush body 28. Of course, it is also possible for the welding edge 19 to be provided at any other desired location to the side of, or on the underside of, the bristle-carrying plate 10. In particular, it is possible for the welding edge to be provided on the centering bead 18.

Figure 2:
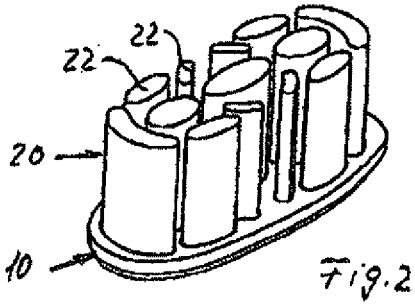

FIG. 2 shows the bristle-carrying plate 10 in the same way as FIG. 1, the bristle-carrying plate here being provided, by means of an AFT method, with a schematically indicated complement 20 of bristles. The complement 20 of bristles has one cluster 22 of bristles for each through-passage 16. Each of the clusters 22 of bristles comprises a multiplicity of bristles; these are described in detail hereinbelow.

Figure 3:
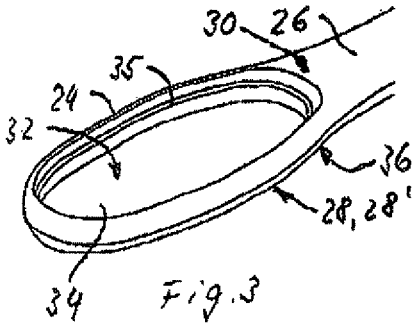
FIG. 3 shows, also in perspective, a head region, and part of a neck region, of a toothbrush body with a recess in the head region.

FIG. 3 shows a head region 24 and part of a neck region 26, adjoining the head region, of a toothbrush body 28. The neck region 26 is adjoined in a generally known manner, at the end which is directed away from the head region 24, by the handle region. The head region 24 is provided from the direction of its front side 30, which is at the top in FIG. 3, with a recess 32, which corresponds essentially to the shape of the bristle-carrying plate 10 and is bounded by a base 34. The side wall of this recess 32 has an encircling shoulder which forms a welding ledge 35. The rear side 36 of the toothbrush body 28 is located on the side opposite to the front side 30 and is at the bottom in the view shown.

Figure 4:
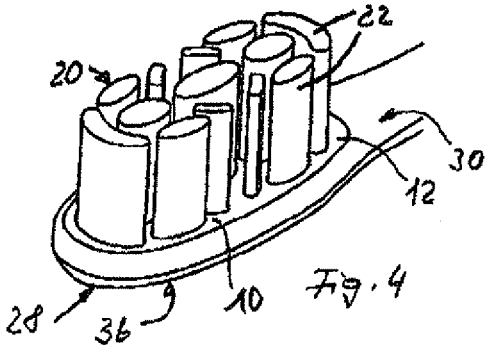
FIG. 4 shows a perspective view of the toothbrush body according to FIG. 3 with a bristle-covered bristle-carrying plate according to FIG. 2 inserted into the recess.

FIG. 4 shows the bristle-carrying plate 10 provided with the complement 20 of bristles as being inserted into the recess 32. The insertion is simplified by the centering bead 18. The upper side 12 of the bristle-carrying plate 10 is preferably aligned with the front side 30 of the toothbrush body 28. The bristle-carrying plate 10 is fixed, preferably by means of ultrasonic welding, to the toothbrush body 28. Welding is carried out here in the region of the welding edge 19 and the welding ledge 35. The complement 20 of bristles projects beyond the upper side 12. FIG. 4 thus shows the head region, and part of the neck region, of a toothbrush 28'. Of course, it is also possible here to use other methods for anchoring bristles or bristle plates (see, for example, methods described above).

The bristle-carrying plate 10 is preferably produced from a hard plastics material, for example polypropylene (PP), polyimide (PA), polyester (PET), polycyclohexanedimethanol terephthalate (PCT/acid-modified PCT/glycol-modified POT), polyethylene (PE), polystyrene (PS), styrene acrylonitrile (SAN), polymethyl methacrylate (PMMA), acrylobutadiene styrene (ABS), polyoxymethylene (POM), etc. Use is preferably made of polypropylene (PP) having a modulus of elasticity of 1000-2400 $N/mm^2$, preferably 1300 to 1800 $N/mm^2$.

In the example shown, the head region 24 and the neck region 26 of the toothbrush body 28 are also produced from one of these hard plastics materials. Use is preferably made of the same hard plastics material for the bristle-carrying plate 10 and the toothbrush body 28, at least in the region of contact between the two parts.

For the sake of completeness, however, is should be mentioned here that both the bristle-carrying plate 10 and the toothbrush body 28 may be produced by multi-component injection molding. It is possible here for both the bristle-carrying plate 10 and the toothbrush body 28 each to be constructed from one or more hard plastics materials and/or from one or more soft plastics materials. Suitable soft plastics materials are, in particular, low-density polyethylene (LDPE), high-density polyethylene (HDPE), polyethylene (PE), elastomeric material, such as polyurethane (PUR), thermoplastic elastomer (TPE), etc. Use is preferably made of a thermoplastic elastomer (TPE). The Shore A hardness of the soft plastics material is preferably below 90. If the bristle-carrying plate 10 consists of one or more hard plastics materials and one or more soft plastics materials, the through-passages 16 are preferably arranged in the hard plastics material. The soft plastics materials can be utilized both for forming additional soft/resilient cleaning elements on the bristle-carrying plate 10 or on the head region 24 or can be provided on the toothbrush body for functional or decorative purposes.

Figure 5:
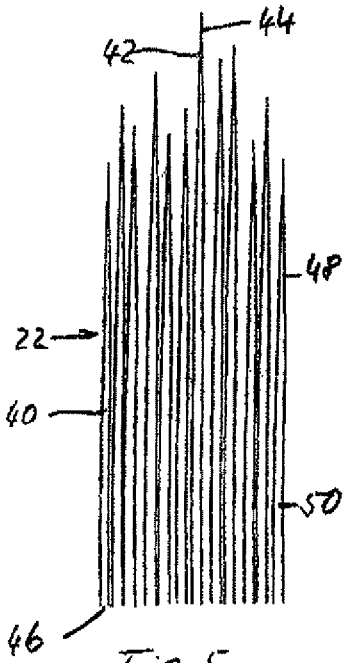
FIG. 5 shows a view of a cluster of chemically tapered bristles with etching-process filaments or residual filaments at the point.

Chemically tapered bristles 40, as illustrated in FIG. 5, are generally known and commercially available. They preferably consist of polyester, and possible subgroups are polybutylene terephthalate (PBT) or polytrimethylene terephthalate (PTT). Polyamide (PA) is preferably used if the bristles are tapered in some other way, for example mechanically or thermally. Particularly bristles 40 tapered chemically, by etching, may have, at their point 42, an extremely thin etching-process filament or residual filament 44 which, at least in one dimension, is smaller than 0.04 mm, in many cases smaller than 0.025 mm and usually smaller than 0.015 mm. The length of the tapered bristles 40 for use in a bristle-covering machine is preferably between 14 mm and 20 mm, preferably 16-18 mm, particularly preferably 17 mm, wherein the bristles 40 are tapered at one end and have a blunt end 46 directed away from the point 42. The relatively large variation in length of the tapered bristles which is evident in FIG. 5 stems from the production process of the bristles.

It is also possible to use bristles which are tapered at two ends and are double the length of the above-described bristles which are tapered at one end, but this means that these bristles with double ended tapering, before they can be processed in a bristle-covering machine, have to be severed in the center to the aforementioned dimensions for bristles which are tapered at one end.

The tapered bristles 40 have a tapered portion 48 with the point 42 and a cylindrical portion 50 with the blunt end 46. The diameter of the cylindrical portion is 0.10 mm to 0.25 mm, preferably 0.15 mm to 0.20 mm. The length of the tapered portion 48, as measured from the point 42, is at least 5 mm, preferably between 7 and 12 mm, in particular between 8 mm and 11 mm. Following the chemical tapering operation, the tapering usually has at the free end, at the point 42 in the region upstream of where the etching-process filament begins, a diameter of 0.015 mm to 0.025 mm, preferably 0.016 mm to 0.018 mm.

Of course, both tapered bristles 40 and conventional bristles 86, which are cylindrical throughout, may have non-circular cross-sectional surface areas. For example, they may have cross-sectional surface areas which are triangular, rectangular, square, rhomboidal, ellipsoidal, polygonal, star-shaped or form regular n-sided or irregular shapes.

Figure 6:
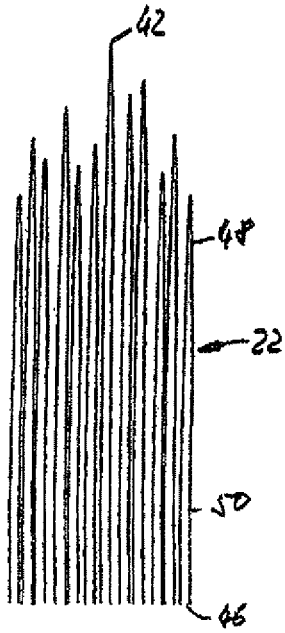
FIG. 6 shows a similar view of a cluster of chemically tapered bristles, this time with the points processed mechanically.

In, order to remove any etching-process filaments or residual filaments 44 which may be present at the tapered end 42 of the bristles 40, all the tapered bristles 40 are processed mechanically in clusters. Following the mechanical processing, the tapering at the point 42 has a diameter of approximately 0.016 mm to 0.035 mm, preferably 0.019 mm to 0.029 mm. FIG. 6 shows the cluster 22 of bristles which has already been illustrated in FIG. 5, but this time once the point have been subjected to the additional mechanical processing according to the invention. The etching-process filaments or residual filaments 44 have been removed and the points 42 are rounded slightly. The following table gives the diameter of the tapered bristles 40 in the tapered portion 48, wherein the distance cited is measured from the point 42 and the diameter is given as a percentage of the diameter of the cylindrical part of the tapered bristle 40.

| | % of the nominal diameter | |
|---|---|---|
| Distance (mm) | Average | Tolerance range |
| 0.1 | 8% | 5-16% |
| 1 | 25% | 15-45% |
| 2 | 45% | 30-75% |
| 3 | 60% | 50-85% |
| 4 | 75% | 60-90% |
| 5 | 80% | 70-95% |
| 6 | 85% | ≧75% |
| 7 | 90% | ≧80% |

Figure 7:
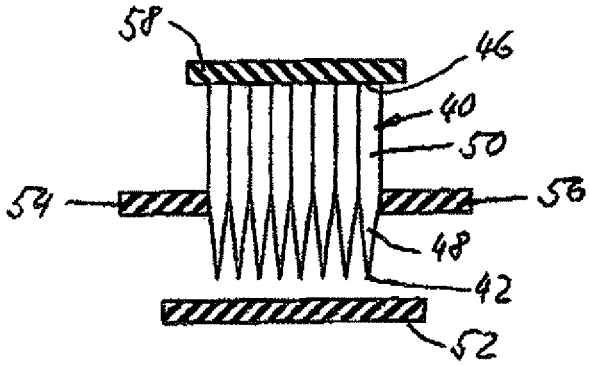
FIG. 7 shows a schematically illustrated cluster of tapered bristles during the mechanical processing of the points.

The points 42 of the tapered bristles 40 are preferably processed by means of a mechanical-processing apparatus, in particular of a grinding disk 52; see FIG. 7 in this respect. The tapered bristles 40 here are retained at least more or less in the transition region between the cylindrical portion 50 and the tapered portion 48. A retaining element 54 may have, for this purpose, an approximately U-shaped cutout into which the tapered bristles 40 are introduced and in which the bristles 40 are secured during the mechanical processing by means of a for example spring-loaded pressure-exerting element 56. In a preferred variant of a bristle-covering machine (for example in an AFT machine), the retaining element 54 used is preferably an element which is integrated in the so-called rounding disk and is assisted by a clamping mechanism fitted outside the disk. The points 42 of the bristles 40 are directed downward and the blunt ends 46 at the top of the bristles 40 butt against a stop plate 58. The latter prevents tapered bristles 40 from yielding out of the way in the direction of the grinding disk 52 on account of the pressure to which the points 42 of the bristles are subjected by the grinding disk 52. Whereas, for the purposes of removing the cutting edges and of rounding off the blunt ends of conventional bristles 86, which are cylindrical over the entire length—see FIG. 11—such grinding disks 52 act on the bristles 86 for up to 13 seconds, the points 42 of the tapered bristles 40 are processed by means of the grinding disk 52, in accordance with the present method, for between 3 seconds and 8 seconds, preferably for 3.5 seconds to 6.5 seconds, in particular between 4 and 6 seconds, depending on the abrasiveness of the grinding disk 52, on method parameters and on the result obtained. The processing period for tapered bristles 40 is thus shorter than the processing period for conventional bristles 86, which are cylindrical throughout. It is possible for both types of bristle to be used in the same brush head and thus also to be processed simultaneously using different method parameters.

The grinding disk 52 is driven eccentrically, and it therefore executes, as seen along its plane, a displacement of 20 to 50 mm, preferably between 30 and 40 mm, in the two directions located at right angles to one another. The displacement of the grinding disk 52, as measured in the longitudinal direction of the bristles 40, is between 0 and 1.5 mm, preferably between 0.2 to 0.6 mm. The grinding disk 52 is preferably moved to the central position of the points 42 of the cluster 22 of bristles, whereupon it processes the points for between 0.3 and 3 seconds, preferably for 0.5 to 1.5 seconds. The position of the grinding disk 52 is then adjusted by 0.1 to 1 mm, preferably 0.2 to 0.6 mm, in the direction of the tapered bristles 40, whereupon the driven grinding disk 52 acts on the tapered bristles 40 for a further 2 to 6 seconds, preferably 3 to 5 seconds. It has been found that any etching-process filaments or residual filaments 44, even those at bristle points 42, which were set back as a result of the variation along the overall length of the bristles 40, are reliably eliminated here. Since the tapered bristles 40, as a result of their tapering and of the arrangement of the retaining means, comprising the retaining element 54 and the spring-loaded pressure-exerting element 56, are extremely flexible in the region of their tapering, it is also the case that there is no risk of them being excessively shortened, in which case there would no longer be any "points" present.

The mechanically processed tapered bristles 40 are preferably fed to an interim store in which they are combined with tapered bristles 40 which have already been processed mechanically beforehand. The bristles 40 are then removed from this interim store in groups for forming the clusters 22 of bristles, see FIG. 2. There is no need here for the tapered bristles 40 of the respective cluster 22 to correspond to the aforementioned cluster for the mechanical processing of the points 42.

It is likewise possible for the clusters 22 of bristles to be put together from a number of removed groups. In particular it is also possible for conventional bristles 86, which are cylindrical throughout, to be mixed with tapered bristles 40 in a cluster.

FIG. 8 shows part of a tool 60 comprising a block-like basic body 62, also referred to as a pallet, and a hopper plate 63 of the bristle-covering machine. An accommodating aperture 64 runs, in the present case vertically, through the block-like basic body 62 of the tool 60. The cross section of this accommodating aperture 64 is constant over the entire length of the rectilinear accommodating aperture 64 in the block-like basic body 62. A pin 66 is guided with a sliding fit in the accommodating aperture 64.

As operation proceeds, the block-like basic body 62 with associated pins 66 is filled with clusters of tapered bristles 40 from a circle-arc element 98—see FIG. 13. Once filling has been completed, in a further station of the bristle-covering machine, the hopper plate 63 is positioned on the basic body 62, as is evident in FIG. 8.

The sliding fit between the basic body 62 and pin 66 is configured such that the points 42 of the mechanically processed tapered bristles 40 have a larger diameter than the tolerance range of the sliding fit. This essential improvement step prevents the tapered bristles 40 from jamming between the pin 66 and the accommodating aperture 64. The sliding fit limits the movement of the pin 66, and therefore the latter is movable only in the block-like basic body 62.

On its top end side 68, which is located in the basic body 62 and against which the points 42 of the tapered bristles 40 butt, the pin 66 is formed, for example concavely, in order to give the relevant cluster 22 of bristles, in its end form, a convex topography. The end form of the cluster 22 of bristles is vastly influenced by the shape of the end side 68 of the pin 66. A concave region of the end side 68 of the pin 66 allows the tapered bristles 40 to be specifically clustered and, as a result, additionally avoids jamming. Instead of a concave configuration, however, any other desired topographies of the end side 68 of the pin 66 are also possible.

A cluster 22 of bristles removed from the interim store and made of a number of tapered bristles 40 which have been processed mechanically beforehand is introduced from above, with the point 42 located at the bottom being in front, into the accommodating aperture 64 of the block-like basic body 62 at least to the extent where all the bristles 40 are located in their entirety in the accommodating aperture 64 and the bristles 40 have their point 42 butting against the end side 68 of the pin 66. The topography or the profile of the cluster 22 of tapered bristles 40 is thus created only following the mechanical processing of the points 42.

The hopper plate 63 is then deposited on the block-like basic body 62 and, if provided for in the method, a bristle-carrying plate 10 is deposited on the hopper plate 63 such that the through-passage 16 of the bristle-carrying plate 10, the through-passage being assigned to this cluster 22 of bristles, is aligned with the corresponding guiding through-passage 69 in the hopper plate 63. The upper side 12 of the bristle-carrying plate 10 here comes into abutment against the hopper plate 63, and therefore the underside 14 of the bristle-carrying plate 10 is exposed in the upward direction. For the sake of completeness, it should be mentioned that this guiding through-passage 69 of the hopper plate 63, at the other end, also corresponds with the accommodating aperture 64. By virtue of the pin 66 being moved upward in the direction of the bristle-carrying plate 10, the tapered bristles 40 are moved upward and pushed, with their blunt end 46 in front, through the hopper plate 63 and the through-passage 16 until an end portion 70 in the cylindrical portion 50 of the bristles 40, this end portion adjoining the blunt end 46, project beyond the underside 14 of the bristle plate 10. A heating die 72 (or some other thermal means) is then lowered onto the bristles 40, or into the vicinity thereof, and therefore the end portions 70 of the bristles 40 melt and form, on the underside 14, a bristle-melt covering which at least partially covers the underside 14, the bristles 40 thus being anchored on the bristle plate 10.

In the same way as described above, the basic body 62 of the tool 60 may have a further accommodating aperture 64' with a further pin 66' guided therein. Conventional bristles 86, which are cylindrical over their length, are introduced into this further accommodating aperture 64', in the same way as described in conjunction with tapered bristles 40; these conventional bristles come into abutment against the end side 68 of the further pin 66' by way of their previously mechanically processed ends 86', wherein it is likewise possible to form a topography—as described above. The hopper plate 63 has a further guiding through-passage 69' which is aligned with the further accommodating aperture 64' and, at the other end, is aligned with a through-passage 16' of the bristle-carrying plate 10 for conventional bristles 86.

The further pin 66' is displaced at the same time as the pin 66, in order to push the cluster of conventional bristles 86 through the further through-passage 16' of the bristle-carrying plate 10 until the cluster of conventional bristles 86 project beyond the underside 14 of the bristle-carrying plate 10 by way of an end portion 70'. It is also the case that this end portion 70' is melted in a manner described above.

If different plastics materials have been used for producing the bristles 40, 86, this consequently also gives rise to a bristle-melt covering made of the corresponding plastics materials. In particular this bristle-melt covering may consist of polyester (tapered bristles 40) and polyamide (conventional bristles 86). Since these—non-affinitive—materials in the bristle melt do not bond together, it should preferably be ensured that the individual materials form groups of clusters of bristles in which the bristle melt can bond within a single group. In this respect, the same types of clusters of bristles are preferably placed in groups in the immediate vicinity of one another. In this case, the clusters 22 of tapered bristles 40 are therefore preferably introduced into accommodating apertures 64, and conventional bristles 86 are preferably introduced into further accommodating apertures 64', which are arranged adjacent to one another—forming a group.

FIG. 9 shows a possible way of providing a bristle-carrying plate 10 with a cluster of bristles which has both tapered bristles 40 and conventional bristles 86. The basic body 62 has an accommodating aperture 64, into which, as described above, tapered bristles 40 are, or have been, introduced, and, immediately alongside the same, a further accommodating aperture 64', into which conventional bristles 86 are, or have been, introduced, cf. FIG. 8. The guiding through-passages 69 and 69' of the hopper plate 63, these through-passages being assigned to the aforementioned accommodating apertures 64 and 64', run toward one another, in the direction of the bristle-carrying plate 10 arranged on the hopper plate 63, such that, at this end, they form a single, common outlet for the bristles 40 and 86. It is also possible for the two through-passages 69 and 69' to form outlets which are still separate, but are located directly one beside the other. The outlet is aligned, or the directly adjacent outlets are aligned, with a through-passage 16 of the bristle-carrying plate 10, this through-passage being common to the bristles 40 and 86. When the pins 66, 66' are moved simultaneously in the direction of the hopper plate 63, the cluster 22 of tapered bristles 40 and the cluster 22 of conventional bristles 86 are pushed through the common through-passage 10 until their end portions 70, 70' project beyond the underside 14 of the bristle plate 10. The bristles 40, 86 are fastened on the bristle-carrying plate 10 by the end portions 70 subsequently being melted, for example by means of the heating die 72.

In a corresponding manner, it is possible for a plurality of individual clusters 22 of bristles 40, 86 from different accommodating apertures 64 to be combined by means of the hopper plate 63 and thus form, together, a cluster of bristles in a common through-passage 16. In the same way, it is also possible for clusters 22 of bristles 40 or 86 of the same type to be fed to a common through-passage 16.

The bristle-carrying plate 10 provided with the complement 20 of bristles, as explained in conjunction with FIG. 4, is removed from the tool 60 and combined with the toothbrush body 28, in a manner known from the prior art, and fastened there.

In bristle-covering methods which do not use any bristle plates 10, as already described, the bristles 40, 86, rather than being guided through the bristle plate 10, are guided into a mold cavity. Plastics material is then injected into this mold cavity in order to form the brush head and to anchor the bristles 40, 86.

FIG. 10 shows a plan view of a portion of a feed channel 74 of a bristle-covering machine 76. This channel is bounded, at the bottom, by a feed base 78 and, on both sides, by parallel feed walls 80. The tapered or possibly cylindrical bristles 40, 86 arranged in the feed channel 74 are pushed in arrow direction A toward an outlet 84 of the feed channel 74 by means of a bar-like pusher 82.

FIG. 11 shows a vertical longitudinal section through a portion of a material channel 74' of a known AFT machine. Conventional bristles 86, which are cylindrical over their entire length, are located in this channel. These bristles stand on the material-channel base 78', which corresponds to the feed base 78, by way of their ends which will later form the free end of the complement 20 of bristles. The diameter of the conventional bristles 86, which is constant throughout, is 0.15 mm to 0.25 mm. The bristles usually have a length of 14 mm to 18 mm, preferably 16 mm. In the known AFT machines, the distance between the material-channel base 78' and the upper edge of the profile-like, cross-sectionally rectangular pusher 82 is 9 mm.

If use is made of bristles 40 which are tapered according to the present invention, the distance between the feed-channel base 78 and the upper edge of the pusher 82 should be selected to be larger, for example between 11 mm and 17 mm, preferably between 13 mm and 16 mm, in particular 14 mm, as is indicated in FIG. 12. FIG. 12 uses dashed lines to indicate the position of the pusher 82 in the material channel 74' of a known bristle-covering machine. The tapered bristles 40 are thus pushed, and retained, in the exclusively cylindrical portion 50, and this avoids the situation where the bristles come away in the direction of the blunt end 46.

According to the present invention, surprisingly, it is possible to use known AFT machines for producing toothbrushes with tapered bristles 40. One adaptation which has to be made has been described above in conjunction with the mechanical processing of the points 42 of the tapered bristles 40. A further adaptation consists, as explained in conjunction with FIGS. 10 to 12, in arranging the pusher 82 at a greater distance from the material-channel base 78.

As already described, conventional bristles 86, which are cylindrical throughout, and tapered bristles 40 can be processed simultaneously in a single bristle-covering machine 76. The bristle-covering machine 76, in this case, has both types of the above-described feed channel 74 and material channel 74' and associated pusher 82.

A further measure for processing tapered bristles 40 consists in a striking plate 88' of the bristle-covering machine being brought to a standstill and thus forming just a stationary boundary plate 88. In addition, it is possible for the boundary plate 88 to have a greater surface area, and therefore it covers a greater part of the feed channel 74 than the known striking plate 88' and thus, together with a cover plate 90 in the end region of the feed channel 74, covers essentially the entire feed channel 74, see also FIG. 13 in this respect. The striking plate 88' is arranged parallel to the material-channel base 78', at a minimal distance therefrom, this distance corresponding at least more or less to the length of conventional bristles 86, and is provided with a vertical back and forth movement in order, by acting on the top ends of the conventional bristles 86, to move the latter toward the material-channel base 78', to hold them in abutment against the same and thus to align the bristles 86.

Comprehensive tests have shown that this is no longer possible if use is made of tapered bristles 40 since the tapered portion 48 with the adjacent point 42 would buckle under excessive pressure in the longitudinal direction of the tapered bristles 40. In order, however, to prevent the situation where tapered bristles 40 come away in the direction of the blunt end 46 of the bristle 40, the stationary boundary plate 88 is arranged above the feed-channel base 78 at a distance which is slightly, for example 0.1 mm to 0.5 mm, preferably 0.2 mm to 0.3 mm, greater than the length of the tapered bristles 40. These bristles stand on the feed-channel base 78 by way of their not yet mechanically processed point 42 and are pushed in the direction of the outlet 84, under a pressure of between 4 bar and 7 bar, preferably from 4 bar to 6 bar, by means of the pusher 82, which acts approximately in the longitudinal center of the cylindrical portion 50 of the tapered bristles 40.

FIG. 13 shows, by way of example, a plan view of a bristle-covering machine 76—in the present case a known AFT machine—wherein this machine, as described above, has been adapted for processing tapered bristles 40. In this context, reference is also made to FIG. 14, where method steps described hereinbelow are shown in the manner of a flow diagram. In the example shown, the bristle-covering machine 76 has two feed channels 74 or material channels 74', which are intended, for example, for tapered bristles 40 of different colors. However, it is also possible to provide just a single such channel or more than two feed channels 74 or material channels 74'. It is likewise possible for a bristle-covering machine 76 to have both feed channels 74 and material channels 74' for tapered bristles 40 and for conventional bristles 86. The ratio of the number of feed channels is determined by the configuration of the complement 20 of bristles of the toothbrush which is to be produced and/or by the respective bristle configuration.

The feed channels 74 or material channels 74' are designed as is shown in FIGS. 10 to 12 and described above. The boundary plate 88 extends, as encountered in the arrow direction A, from the outlet 84 over approximately ⅔ of the overall length of the feed channel 74 or material channel 74'. The cover plate 90 is articulated at the upstream end of the boundary plate 88, and this cover plate is swung up in order for supply clusters of bristles to placed in position. The tapered bristles 40 are supplied in supply clusters, wherein the points 42 of all the bristles 40 are oriented in the same direction and the supply clusters of bristles have a diameter of, for example, 3 to 5 cm. The supply clusters of bristles are preferably of elliptical to rectangular configuration on account of their transporting medium, elongate cardboard packaging. The length of the supply clusters of bristles is from 40 mm to 60 mm, preferably from 45 mm to 55 mm, with a width of 25 mm to 40 mm, preferably 30 mm to 35 mm. In this configuration/supply form, the width of the supply cluster of bristles corresponds essentially to the width of the feed channel 74. This allows relatively straightforward introduction of the supply clusters of bristles into the feed channel 74 without the fragile supply clusters of bristles having to be deformed to an excessive extent. Furthermore, this form of supply cluster of bristles can be transported in a more straightforward and space-saving manner in elongate cardboard packaging. In addition, the supply clusters of bristles have a retaining strip of defined length running laterally around the cluster, this retaining strip holding the large number of tapered bristles 40 together. The defined length of the retaining strip means that virtually no pressure is applied to the tapered bristles in the supply cluster of bristles.

The supply clusters of bristles are positioned with the points 42 of the bristles 40 directed downward into the feed channel 74 or material channel 74', are fed manually in the direction of the bristles 40 already present in the channel, are clamped in the direction of the pusher 82 by means of a manually operable carriage and are then freed manually, preferably in the vertical direction, from the retaining strip. The pusher 82, following manual release, is then automatically moved laterally out of the feed channel 74 or material channel 74', wherein the newly positioned tapered bristles 40 are brought into abutment, by the carriage exerting pressure on them, against the tapered bristles 40 which are already present in the feed channel 74 or material channel 74'. The pusher 82 is moved back to the carriage and repositioned behind the introduced bristles 40 in order then, furthermore, for all the tapered bristles 40 present in the feed channel 74 or material channel 74' to be pushed, and fed, thereby toward the outlet 84.

Whereas in the known AFT method the conventional bristles 86 in the material channel 74' are struck by means of the striking plate 88' and are thus aligned vertically, in the present method the boundary plate 88 or the stationary striking plate 88' provides only for the bristles to be aligned roughly in their vertical position and for preventing them from coming away in the upward direction.

At the outlet 84 of the feed channels 74 or material channels 74', a respective group of tapered bristles 40 is separated from the supply. This can take place, with use being made of a known bristle-covering machine, in a known manner by means of a rounding disk 54', which may correspond to the retaining element 54, see FIG. 7. This disk has apertures, indicated by a dashed line, into which the group of bristles 40 is pushed under the action of the pusher 82. The rounding disk 54' is then rotated about its axis through an angle in relation to the mechanical processing station for the point 42 of the bristles 40. FIG. 13 illustrates the stop plate 58 beneath which are located the pressure-exerting element 56, which interacts with the rounding disk 54', and the driven grinding disk 52, see FIG. 7 in this respect. During this mechanical processing of the points 42 of the tapered bristles 40, any etching-process filaments or residual filaments 44 which may be present are ground away and, if need be, the points 42 are minimally rounded or broken.

The rounding disks 54' are adjacent to the movement path 94 of so-called segments 96. Two groups of segments 96 are shown here, and these can be moved independently of one another along the movement path 94. The segments 96 form an interim store for the bristles 40 with mechanically processed points 42. Following the mechanical processing of the points 42, the rounding disk 54' is rotated further in the same direction of rotation and, as soon as an aperture with bristles 40 reaches the movement path 94, these bristles 40 are pushed into a corresponding segment 96. It is also the case that this operation as well as the activation and the construction of the segments 96 and the discharge of clusters 22 of bristles 40 from the segments 96 to the so-called circle-arc element 98 are known in general from bristle-covering machines and in particular from AFT machines.

The circle-arc element 98 receives a cluster 22 of bristles 40 from the relevant segment 96 and brings them to the tool 60 or the corresponding accommodating aperture 64 in the block-like basic body 62, of the pallet or of the tool 60 of a bristle-covering machine; see also FIG. 8 in this respect. There, as is known from bristle-covering machines, in particular AFT machines, the tapered bristles 40 are introduced into the accommodating aperture 64, the hopper plate 63 is placed in position, the bristle-carrying plate 10 is positioned thereon, the relevant cluster 22 of bristles is pushed out of the accommodating aperture 64 through the guiding through-passage 69 of the hopper plate 63, and the relevant through-passage 16, and in the process is aligned in accordance with the end side 68 of the pin 66. The same process proceeds in precisely the same way for supplying the rest of the through-passages 16 of the bristle-carrying plate 10 with tapered bristles or conventional bristles 86, wherein all the clusters 22 are subjected to pushing action preferably simultaneously. As soon as this operation of supplying clusters 22 of bristles has been completed, the end portions 70 are melted, for example by means of the heating die 72, in order to fasten the bristles 40 on the bristle-carrying plate 10. The bristle-carrying plate 10 provided with the complement 20 of bristles is then removed from the tool 60 or the pallet, inserted into the recess 32 of the toothbrush body 28 and fastened therein, for example by means of ultrasonic welding.

In bristle-covering methods which do not use bristle plates 10, as already described, the bristles, rather than being guided through the bristle plate 10, are guided into a cavity of an injection mold. Plastics material is then injected into this mold cavity in order to form the brush head and to anchor the bristles.

The geometrical requirements which have to be met by the configuration of the bristle-carrying plate 10 and of the recess 32 for the purposes of the AFT process also apply to the present, slightly modified process.

It is also conceivable for one or more of the material channels 74' to be supplied with conventional bristles in order to form, on the finished toothbrush, a complement 20 of bristles which has clusters 22 of tapered bristles 40 and other clusters of conventional bristles 86. The conventional bristles 86 are processed, and treated, in accordance with the previously known method.

For the sake of completeness, it should be mentioned that the bristle plates 10 may be provided with soft/resilient cleaning elements, for example made of a soft plastics material, which have been molded on the bristle-carrying plate 10 by injection molding involving two or more components.

Furthermore, the present invention makes it possible to form complements 20 of bristles in which an individual cluster of bristles has both tapered bristles 40 and conventional bristles 86. In this case, the tapered bristles 40 are processed by the method according to the invention, whereas the conventional bristles are processed by the previously known method, but the activation of the segments 96 and the corresponding design of the circle-arc element 98 ensure that the relevant clusters 22 of bristles have a mixture of tapered bristles 40 and conventional bristles 86. In this context, reference is also made to the alternative option according to FIG. 9 and the description relating thereto.

The invention can be used for bristle arrangements for a wide variety of different products. For example, manual toothbrushes, electric toothbrushes with oscillating, pivoting or translatory movement, vibrating/sonic toothbrushes, or toothbrushes with combined movements, may be provided with tapered bristles. The same goes for tongue-cleaning brushes arranged on toothbrushes or for tongue cleaners alone.

It is generally also possible to provide combined bristle arrangements. These may have integrated in them clusters of bristles which are tufted conventionally using anchor plates and also clusters which are fastened in an anchor-free manner.

The present invention can also be used in methods known from DE 200 06311 U1, EP 0 346 646, DE 10 2006 026 712 A1 and WO 2004/093718 A1 and in corresponding apparatuses and/or bristle-covering machines. Reference is therefore made expressly to the disclosure of these documents, and the latter are included by reference.

The invention claimed is:

1. A method for producing toothbrushes covered with bristles in an anchor-free manner using a bristle covering machine with a tool having an upper side, a bottom side and an accommodating aperture in which a pin is slideably guided, the method comprising:

providing bristles which are chemically tapered at one end, the bristles having a tapered portion which tapers to a point, a cylindrical portion which adjoins the tapered portion, and a blunt end;

mechanically processing points of the chemically tapered bristles, after the step of providing, the bristles, whereby etching-process filaments or residual filaments of the chemically tapered bristles are removed;

introducing, after the step of mechanically processing the points, from the upper side, a cluster of the chemically tapered and mechanically processed bristles into the accommodating aperture of the tool such that the bristles are received in the accommodating aperture and the points of the bristles are brought into abutment with a front face of the pin; and moving the pin to push the bristles in an upward direction of the tool for further processing, whereby the front face of the pin acts on the points of the chemically tapered and mechanically processed bristles.

2. The method as claimed in claim 1, wherein the points of the chemically tapered bristles are processed mechanically in the bristle-covering machine.

3. The method as claimed in claim 1, wherein, during the mechanical processing, the points of the chemically tapered bristles are ground.

4. The method as claimed in claim 1, wherein use is made of the chemically tapered bristles of which the tapered portion has at least a length of 5 mm.

5. The method as claimed in claim 1, wherein the chemically tapered bristles, during the mechanical processing of the points, are retained at least in a transition region between the cylindrical portion and the tapered portion, and of a pressure-exerting element which interacts therewith.

6. The method as claimed in claim 5, wherein the chemical tapered bristles during the mechanical processing of the points are retained in an aligned state by means of a stop plate which interacts with the blunt end of the bristles.

7. The method as claimed in claim 1, wherein the points of the chemically tapered bristles are processed mechanically such that the points have a diameter which is larger than a tolerance range of a slideably guided fit between the tool and the pin.

8. The method as claimed in claim 1, wherein the cluster of bristles is given a convex topography by a concave end side of the pin acting on the points of the chemically tapered bristles.

9. The method as claimed in claim 1, wherein a topography is created on the cluster of chemically tapered bristles only following the mechanical processing of the points.

10. The method as claimed in claim 1, wherein the chemically tapered bristles, prior to the mechanical processing of the points, are positioned with the point directed downward in a feed channel, and in the feed channel, a pusher acts on the cylindrical portion of the bristles to push in a direction of an outlet of the feed channel.

11. The method as claimed in claim 10, wherein the chemically tapered bristles are retained in the feed channel by means of a boundary plate which interacts with the blunt end of the bristles.

12. The method as claimed in claim 1, wherein a bristle-carrying plate having a through-passage is arranged on the tool, the chemically tapered bristles of the cluster of bristles are pushed through the through-passage by means of the pin such that the chemically tapered bristles project beyond an underside at a top of the bristle-carrying plate by way of an end portion of the cylindrical portion, the end portion having the blunt end, and the end portion of the bristles are melted to fasten the chemically tapered bristles on the bristle-carrying plate.

13. The method as claimed in claim 12, wherein the bristle-carrying plate provided with a complement of bristles is fastened on a head region of a toothbrush body.

14. The method of claim 1, wherein:

a grinding disk mechanically processes the points of the chemically tapered bristles retained by a rounding disk; and a pusher is arranged in a feed channel at such a distance above a channel base that the pusher acts on the cylindrical portion of the chemically tapered bristles, the points of the chemically tapered bristles are directed toward the channel base.

15. The method as claimed in claim 14, further comprising holding a striking plate of the bristle-covering machine at a standstill.

16. A method for producing toothbrushes covered with bristles in an anchor-free manner comprising:

introducing a first cluster of bristles into a first accommodating aperture of a tool of a bristle-covering machine, the first cluster of bristles includes tapered bristles, introducing a second cluster of bristles into a second accommodating aperture of the tool of the bristle-covering machine, the second cluster of bristles includes conventional bristles, which are cylindrical throughout, guiding a first pin into the first accommodating aperture to align the tapered bristles on ends of the tapered bristles directed toward the first pin, and guiding a second pin into the second accommodating aperture to align the conventional bristles on ends of the conventional bristles directed toward the second pin, wherein prior to introduction into the first accommodating aperture, the bristles of the first cluster of bristles are tapered chemically at one end, having a tapered portion which tapers to a point, a cylindrical portion which adjoins the tapered portion, and a blunt end, and points of the tapered bristles are processed mechanically, the tapered bristles are introduced into the first accommodating aperture such that the tapered bristles are located in the first aperture so that the first pin acts on the points of the tapered bristles, prior to introduction into the second accommodating aperture, the ends of the conventional bristles are mechanically processed in the bristle-covering machine, and the conventional bristles are introduced into the second accommodating aperture such that the conventional bristles are located in the second aperture so that the second pin acts on the ends of the conventional bristles which are mechanically processed.

17. The method as claimed in claim 16, wherein the tapered bristles are processed mechanically over a shorter processing period than the conventional bristles.

18. The method as claimed in claim 16, wherein a respective cluster of tapered bristles is introduced into a plurality of closely adjacent accommodating apertures of the tool and a respective cluster of conventional bristles is introduced into a plurality of closely adjacent further recesses of the tool.

19. The method as claimed in claim 16, wherein a bristle-carrying plate having a through-passage is arranged on the tool, the tapered bristles are pushed through the through-passage by means of the first pin, and the conventional bristles are pushed through the through-passage simultaneously by means of the second pin, such that the tapered bristles project beyond an underside at a top of the bristle-carrying plate by way of an end portion of the cylindrical portion, the end portion having the blunt end, and the conventional bristles project beyond the underside at the top of the bristle-carrying plate likewise by way of an end portion and end portions of the bristles are melted to fasten the bristles on the bristle-carrying plate.

* * * * *